US009046229B2

(12) United States Patent
Bennett et al.

(10) Patent No.: US 9,046,229 B2
(45) Date of Patent: Jun. 2, 2015

(54) STACKABLE LED FLARE AND SYSTEM

(71) Applicant: Aervoe Industries, Inc., Gardnervile, NV (US)

(72) Inventors: Michael Joseph Bennett, Zephyr Cove, NV (US); Troy Wilson, Minden, NV (US); Robert Haelsig, Minden, NV (US); Chuanzhong He, Shenzen (CN)

(73) Assignee: Aervoe Industries, Inc., Gardnerville, NV (US)

( * ) Notice: Subject to any disclaimer, the term of this patent is extended or adjusted under 35 U.S.C. 154(b) by 35 days.

(21) Appl. No.: 14/017,489

(22) Filed: Sep. 4, 2013

(65) Prior Publication Data

US 2014/0126187 A1 May 8, 2014

Related U.S. Application Data

(60) Provisional application No. 61/723,425, filed on Nov. 7, 2012.

(51) Int. Cl.

| | |
|---|---|
| ***F21L 4/00*** | (2006.01) |
| ***F21L 2/00*** | (2006.01) |
| ***F21L 4/08*** | (2006.01) |
| *F21W 111/00* | (2006.01) |

(52) U.S. Cl.

CPC ... *F21L 2/00* (2013.01); *F21L 4/08* (2013.01); *F21W 2111/00* (2013.01)

(58) Field of Classification Search

CPC ..... F21L 4/08
USPC ..... 362/183, 157, 154, 362
See application file for complete search history.

(56) References Cited

U.S. PATENT DOCUMENTS

| | | | | |
|---|---|---|---|---|
| 4,282,562 | A | 8/1981 | Marino | |
| 4,926,300 | A | 5/1990 | Ralston | |
| 5,081,568 | A | 1/1992 | Dong | |
| 6,350,040 | B1 * | 2/2002 | Parker | 362/183 |
| 6,486,797 | B1 | 11/2002 | Laidman | |
| D515,958 | S | 2/2006 | Dueker | |
| 7,088,222 | B1 | 8/2006 | Dueker | |
| 7,261,456 | B2 | 8/2007 | Liu | |
| D561,566 | S | 2/2008 | Perez Delgado | |
| 7,784,204 | B2 | 8/2010 | Staats et al. | |
| 8,147,087 | B2 | 4/2012 | Chen | |
| 8,550,653 | B2 * | 10/2013 | Wilson et al. | 362/183 |
| 2002/0105432 | A1 | 8/2002 | Pederson et al. | |
| 2002/0180616 | A1 | 12/2002 | Laidman | |
| 2002/0191396 | A1 | 12/2002 | Reiff et al. | |
| 2004/0130886 | A1 | 7/2004 | Lewis et al. | |
| 2004/0145890 | A1 | 7/2004 | Liao | |

(Continued)

*Primary Examiner* — Evan Dzierzynski
(74) *Attorney, Agent, or Firm* — Watson Rounds; Marc D. Foodman

(57) ABSTRACT

A stackable LED flare and system for use at night, in low light conditions or during the day where a lighted flare provides greater visibility. The flare comprises a multi-sided housing with a panel on each side and having a top and a base. It has a plurality of LEDs aligned in windows positioned in at least one of the panels. The flare includes a re-chargeable battery encased in the housing for powering the flare and a circuit for delivering power and operational control from the battery to the LEDs upon activation by a switch. A set of contacts positioned on the outside of the housing deliver a charge to the battery. The contacts are configured to allow multiple flares to be stacked and charged simultaneously. The system also includes a charging station that accommodates a stack of two or more flares during the charging operation.

30 Claims, 22 Drawing Sheets

(56) References Cited

U.S. PATENT DOCUMENTS

| | | | |
|---|---|---|---|
| 2007/0121332 | A1 | 5/2007 | Liu |
| 2007/0176784 | A1 | 8/2007 | Fautin |
| 2008/0036584 | A1 | 2/2008 | Lang et al. |
| 2011/0096534 | A1 | 4/2011 | Lee |
| 2012/0287611 | A1 | 11/2012 | Wilson et al. |

* cited by examiner

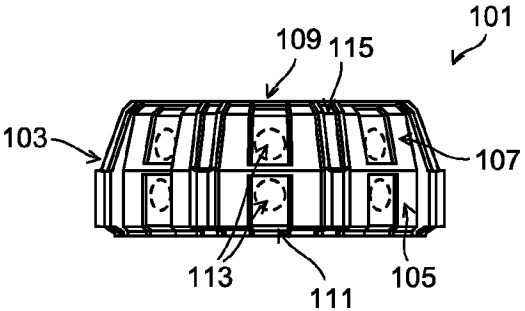
FIG. 1A
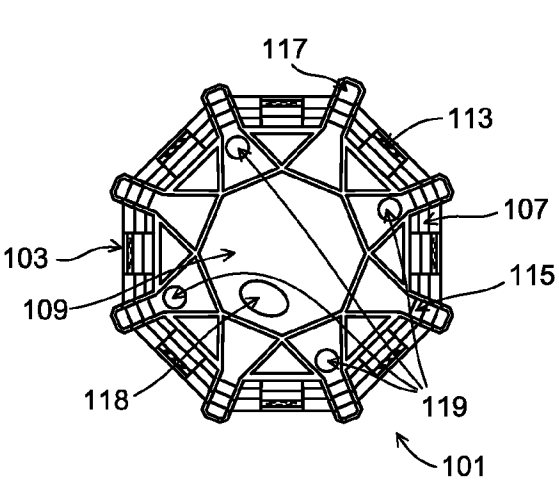
FIG. 1C
FIG. 1D
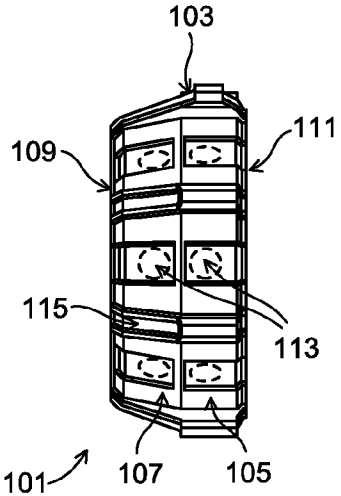
FIG. 1B

STACKABLE LED FLARE AND SYSTEM

RELATED CASE INFORMATION

This case is a continuation-in-part of U.S. patent application Ser. No. 13/105,994 filed May 12, 2011, entitled LED Flare, and also claims priority benefit from U.S. Provisional Application No. 61/723,425, filed Nov. 7, 2012 entitled Stackable LED Flare and System, both of which are incorporated herein by reference in their entirety. The present application is also related to commonly-owned, co-pending U.S. Design patent application Ser. No. 29/391,694 filed May 12, 2001, entitled "LED Flare." and issued on Feb. 21, 2012 as D654,387.

COPYRIGHT NOTICE

Portions of this disclosure contain material in which copyright is claimed by the applicant. The applicant has no objection to the copying of this material in the course of making copies of the application file or any patents that may issue on the application, but all other rights whatsoever in the copyrighted material are reserved.

BACKGROUND

Battery powered LED flares are used by police, fire, airport workers, construction crews, emergency personnel and others to provide warning signals of all kinds at night, in low light conditions or even during the day where a lighted object provides greater visibility.

These types of devices are limited by the number and configuration of LEDs that are incorporated in them. It is desirable to increase the distance at which the warning signals can be seen. Additionally, devices of this type may not be durable to withstand harsh treatment such as being dropped on the ground or operating in inclement conditions such as very cold temperatures, rain, sleet or snow. Another shortcoming is that they are battery operated and require maintaining a backup set of batteries in the event that the batteries fail. In cases where the devices use rechargeable batteries, they must be removed from the unit and placed in a separate charger. Charging multiple LED flares at the same time may require an individual charger for each LED flare or a large charging station that takes up significant space.

BRIEF DESCRIPTION OF THE DRAWINGS

FIGS. 1A-1F show a variety of views of a LED flare in a first embodiment;

DETAILED DESCRIPTION

Figure 1F:
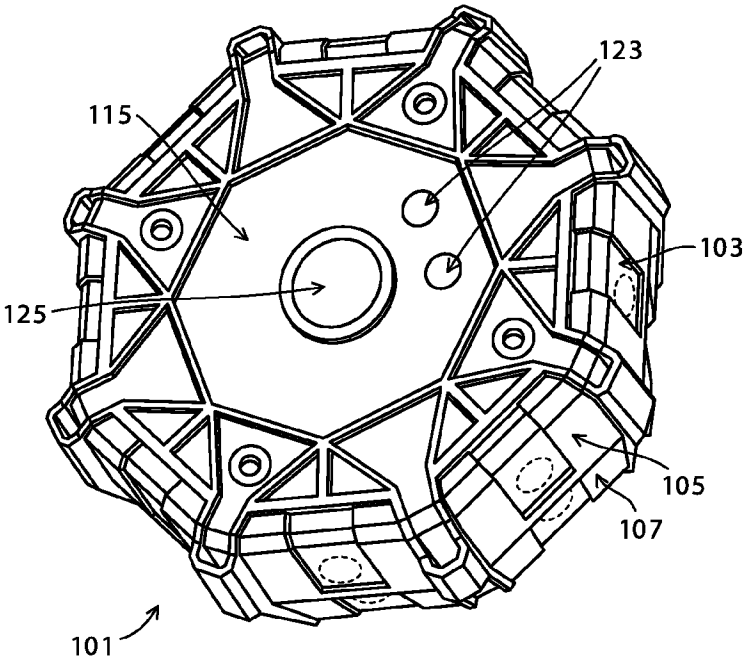

The present invention will now be described more fully with reference to the accompanying drawings. It should be understood that the invention may be embodied in many different forms and should not be construed as limited to the embodiments set forth herein. Throughout FIGS. 1-12, like elements of the invention are referred to by the same reference numerals for consistency purposes.

FIGS. 1A-1F show a variety of views of a LED flare 101. As can be seen in FIG. 1A, LED flare 101 has a body that is multi-sided. In FIG. 1A, LED flare is octagonal, but it may be formed with any number of sides around the periphery. In the embodiment shown, periphery or side 103 is made up of 8 pairs of stacked panels. In each pair, there is a lower panel 105 and an upper panel 107. Upper panel 107 is angled inwardly towards a top 109 of flare 101 while lower panel 105 is at approximately a right angle with a bottom 111 of flare 101. A window 113 is formed in each upper panel 107 and in each lower panel 105. A protective casing 115 or shield made of rubber, plastic or silicone is formed in a top component 115*a* (see FIG. 3) and a bottom component 115*b* (see FIG. 3) over the body of flare 101 to cushion the internal components of flare 101 in the event that flare 101 is dropped, hit or otherwise subjected to harsh conditions. Cut-outs in protective casing 115 are aligned with windows 113 so that light emitted through windows 113 is not blocked by protective casing 115. A hanger 117 is integrated into protective shield 115 through which a string, wire or carabiner can be passed to allow LED flare 101 to be hung from a hook or other rod-shaped device. A switch 118 is mounted in top 109 to turn LED flare 101 on and off as well as perform other operational functions.

Both top 109 and bottom 111 of LED flare 101 are substantially flat on one side as can be seen in a top up view of LED flare 101 shown in FIG. 1C and a bottom up view of LED flare 101 shown in FIG. 1D. Backs 121 in the form of nuts or other similar holding components in combination with binding posts 119 which may be screws rivets or other attachment pins hold top 109 and bottom 111 of LED flare 101 together while a pair of charging posts 123 are used to connect a charger that recharges one or more re-chargeable batteries housed inside of the body of LED flare 101. Attachment device 125 is preferably a magnet so that it can be easily and quickly attached, removed and re-attached to magnetic objects such as the side of vehicle or a metal sign without damaging the object to which it is attached. As an alternative, attachment device 125 may be one side of Velcro® type hook and loop fasteners or a reusable sticky material.

Figure 1E:
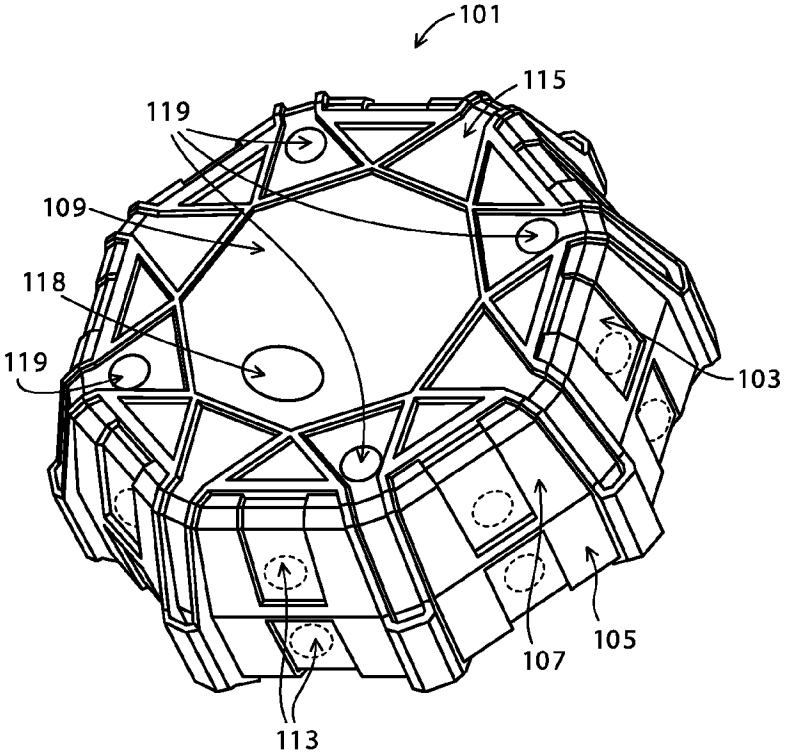
Figure 2A:
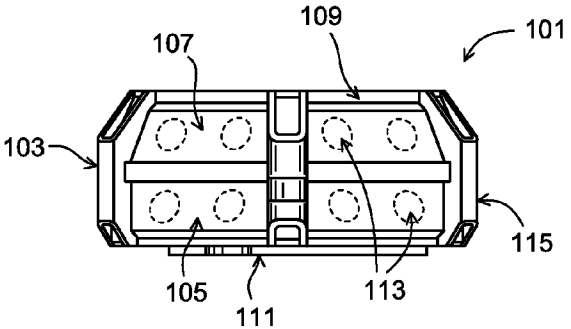
FIGS. 2A-F show views of a LED flare in a second embodiment
Figure 2D:
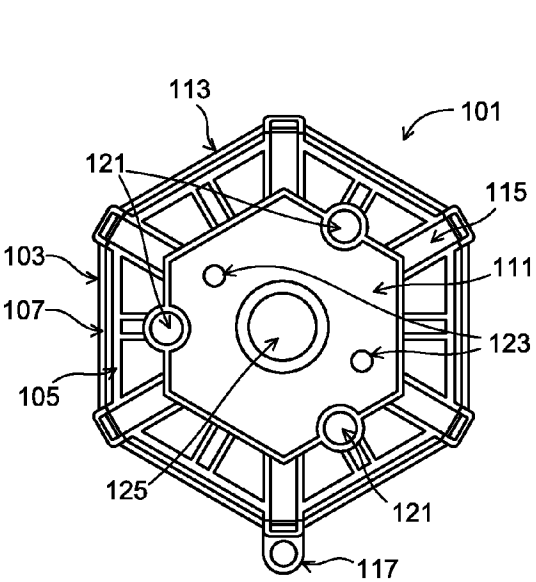
Figure 2C:
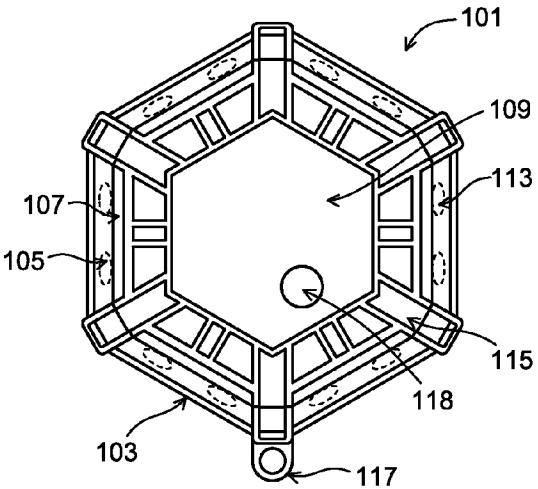
Figure 2B:
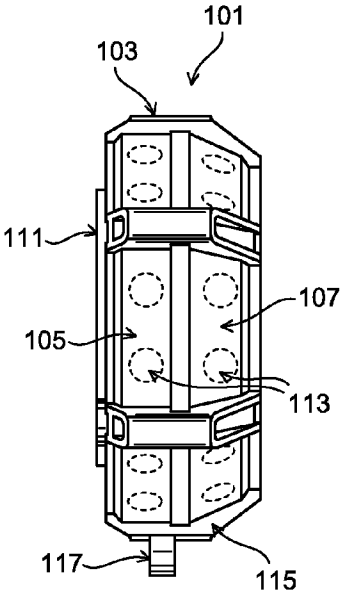
Figure 2F:
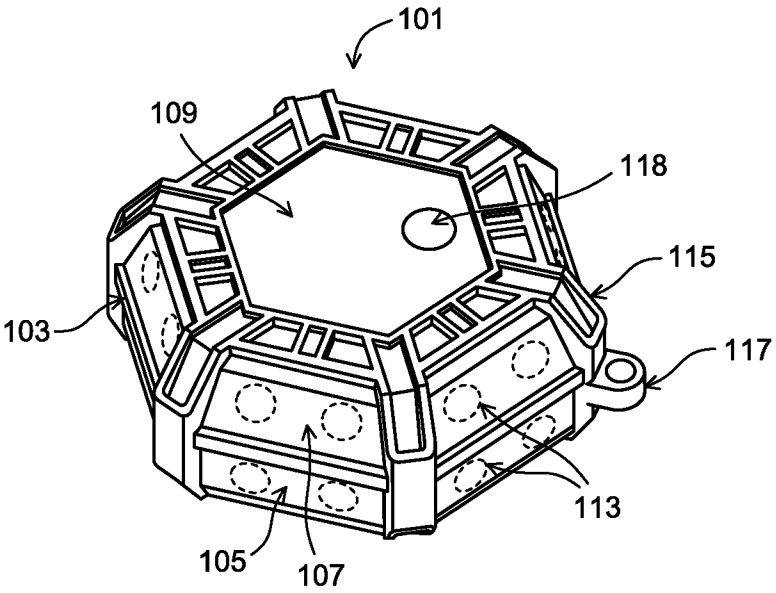
Figure 2E:
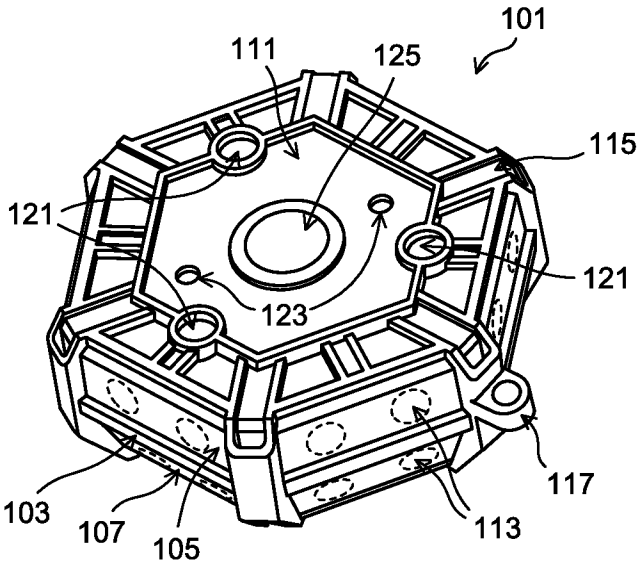

FIGS. 1E and 1F are a top and bottom perspective view of LED flare 101, respectively. Flare 101 may be produced in any number of different sizes that provide for a lightweight, durable and easy to use, store and carry flare 101. A configuration of 8 pairs of LEDs on the periphery 103 generates light patterns that are visible at multiple angles and from long distances to signal to people there is an emergency situation or other circumstances where a warning is appropriate. LED flare 101 with eight sides may have dimensions as follows: bottom diameter—4.528 inches (115 mm); top diameter—

3.976 inches (101 mm); lower side panel width—0.730 inches (18.542 mm); upper side panel width—0.730 inches (37 mm) where the upper panel meets the lower panel and gradually narrowing to 0.5118 inches (13 mm) where the upper panel meets the top; lower side panel height—1.1024 inches (28 mm); upper side panel height—0.8661 inches (22 mm); and the angle between lower panel and upper panel—in the range of 15-30 degrees. These dimensions are provided as an example and other dimensions can be implemented as desired. It should be recognized that configurations with more LEDs or fewer LEDs could be implemented without altering the operation of the flare, including having more or fewer side panels than the eight described.

FIGS. 2A-2F show the same set of views as FIGS. 1A-1F for a second embodiment of LED flare 101. In this second embodiment, LED flare 101 is designed with six sides instead of the eight shown for the LED flare shown in FIGS. 1A-1F. LED flare 101 with six sides may have dimensions as follows: bottom diameter—3.975 inches (100.965 mm); top diameter—3.575 inches (90.8 mm); lower side panel width—0.730 inches (18.542 mm); upper side panel width—0.730 inches (18.542 mm) where the upper panel meets the lower panel and gradually narrowing to 0.530 inches (13.462 mm) where the upper panel meets the top; lower side panel height—0.875 inches (22.225 mm); upper side panel height—0.970 inches (24.638 mm); and the angle between lower panel and upper panel—in the range of 15-30 degrees. These dimensions are provided as an example and other dimensions can be implemented as desired. It should be understood that throughout the specification, reference to LED flare 101 shall include a flare with 6 or 8 sides, or in any number of other practical configurations.

Figure 3A:
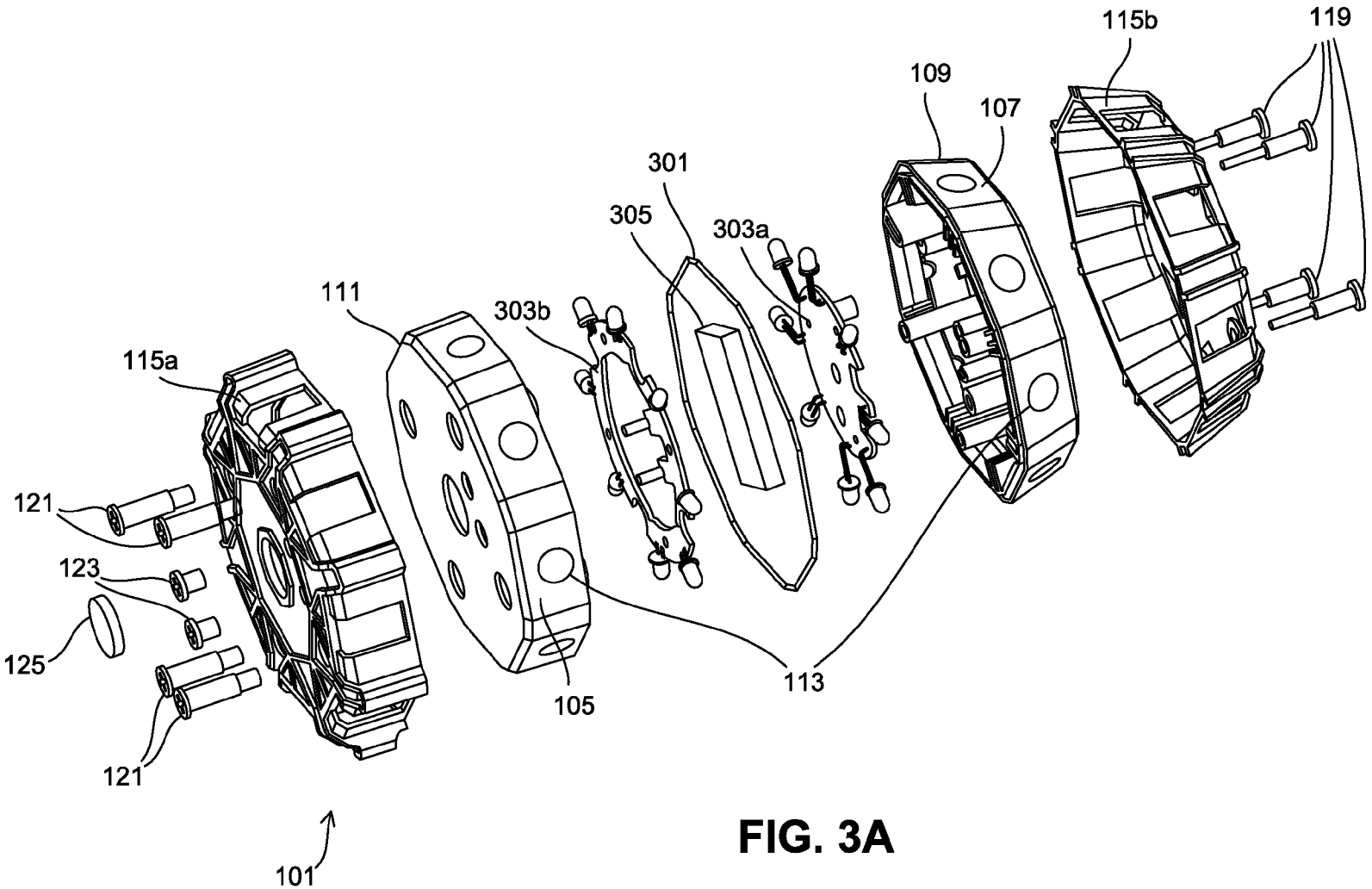
FIGS. 3A-D are perspective views of a LED flare including its component parts.

FIG. 3A is an exploded perspective view showing the individual components of LED flare 101 in relative position to each other. Top 109 and bottom 111 are formed of clear hard plastic and fit together to form a housing with a seal ring 201 fitted between them to resist penetration of water into the interior of the housing. Binding posts 119 and backs 121 hold the housing together. Fitted over the housing of flare 101 is a molded casing made of two parts, bottom case panel 115*a* and top case panel 115*b*. Both case panels are made of a rubber material that is semi-rigid to allow for easy installation over the housing of flare 101, while providing cushioning in the event that flare 101 is dropped or banged against a hard surface. The molded case also provides a texture over the housing of flare 101 for easy and comfortable grip.

Inside the housing of flare 101 are LED modules 303*a* and 303*b*. The modules are each configured in the shape of the housing with one or more LEDs positioned to align with windows 113 along periphery 103 of flare 101. LED modules 303*a* and 303*b* are positioned inside of the housing so that each upper panel 107 and a corresponding lower panel have an LED stacked one on top of the other. A rechargeable battery 305 is also enclosed in the housing and is in electrical connection with charging posts 123.

Figure 3D:
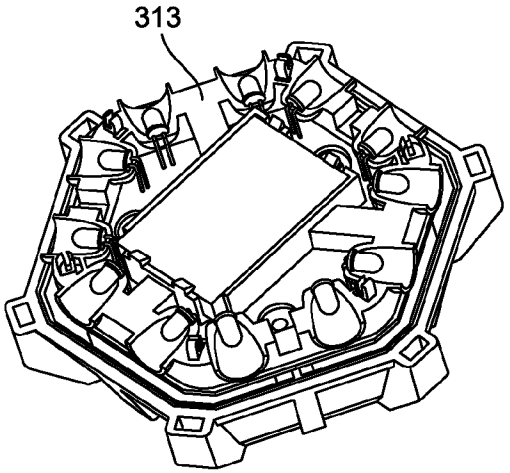
Figure 3C:
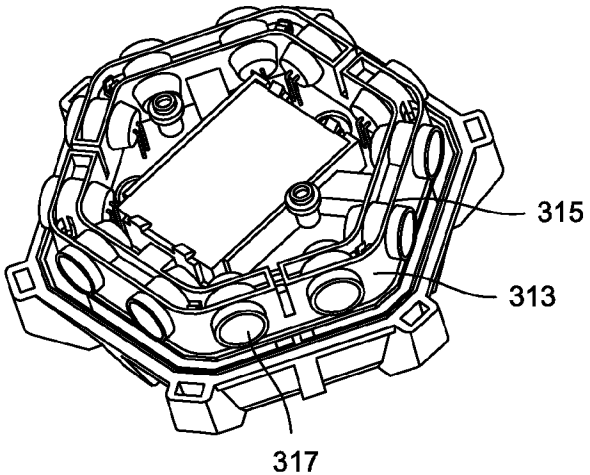
Figure 3B:
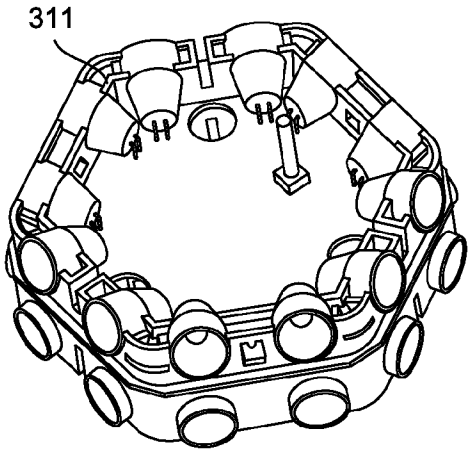

FIGS. 3B-3D show perspective views of a light focusing component 311 that may be used in LED flare 101. Light focusing component 311 includes a bottom section 313 and a matching top section 315 that fit together to form light channels 317 that surround each of the individual LEDs in LED modules 303. Bottom section 313 may fit between bottom 111 of flare 101 and light module 303*b* in FIG. 3A and top section 315 may fit between light module 303*b* and seal ring 301 to encase light module 303*b* and direct light from the LEDs in a radially outward direction through window 113. Similarly another light focusing component 311 fits around light module 303*a* with bottom section 313 between light module 303*a* and seal ring 301, and top section 313 between light module 303*a* and top 109 of flare 101.

Figure 4:
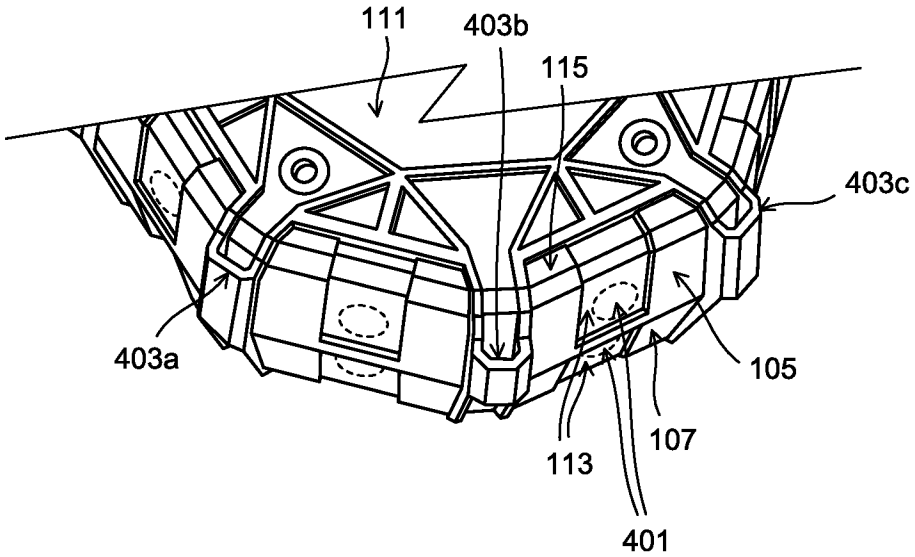
FIG. 4 is a perspective partial view of a LED flare with a window having a magnifying lens.

FIG. 4 is a close up perspective view of lower panel 105 and upper panel 107 on periphery 103 of flare 101 with flare 101 in a bottom facing up position. Windows 113 are centered within each panel. Individual LEDs are positioned within each window to emit light through window 113. A magnifying lens 401 may be integrated in window 113 to magnify the light emitted by the LED behind window 301. LED flare 101 may operate with or without magnifying lens 401 and with or without light focusing component 311. As can be seen in FIG. 4, a pair of LEDs stacked one on top of the other in lower panel 105 and upper panel 107. The stacking configuration enables a multitude of light patterns from the LEDs. Also shown in FIG. 4 are loops 403 formed in casing 115. In the event that flare 101 is dropped and lands on a loop 403, the rubber loop depresses providing a cushioning action to lessen the impact when flare 101 hits a surface.

Figure 5A:
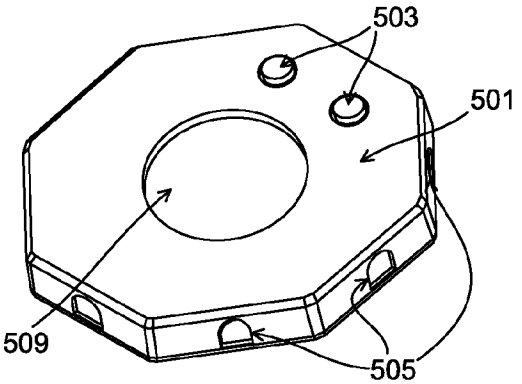
FIGS. 5A-5E are perspective views of a LED flare charger by itself and in charging position on a LED flare in a first embodiment.
Figure 5B:
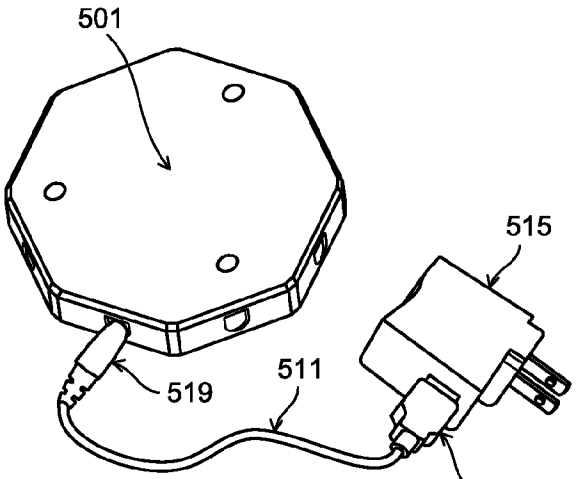

FIGS. 5A and 5B show perspective top and bottom views, respectively, of a charger 501. In FIG. 5A, a charger 501 is shown that attaches to flare 101 for charging battery 305. Charger 501 has charger contacts 503 that protrude slightly from the face of charger 501 to engage charging posts 123 on flare 101, which are slightly recessed into protective casing 115 on flare 101. Recessing the ends of charging posts 123 below the surface of casing 115 is preferred to avoid an inadvertent short circuit of battery 305 which is in electrical connection with charging posts 123.

It should be understood that while charger 501 may be any shape provided it houses charging contacts to align with charging posts 123, configuring charger 501 in a multi-sided shape with side panels 505, such as that pictured in FIGS. 5A-D with eight sides, permits charger 501 to fit within a raised frame 507 outlined in protective casing 115 on flare 101. Charger 501 also includes an attachment device 509 such as a magnet that is opposite in polarity to magnet 125 mounted inside of flare 101 so that they attract and hold charger 501 in place against flare 101.

Figure 5C:
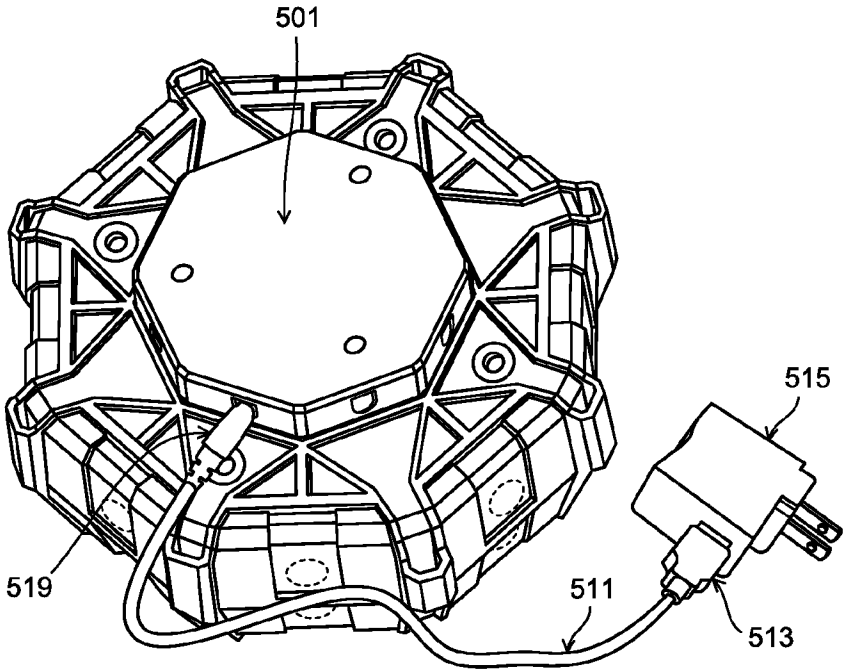

FIG. 5C shows a bottom up perspective view of LED flare 101 with charger 501 attached to charger contacts 503. Charger 501 is used to charge battery 305 housed inside of LED flare 101 by making contact with charger contacts 503. Charger 501 has a removable power cord 511 that can be plugged into charger at connector 521 and that draws power either from an AC or DC. Attachment device 509 holds charger 503 in place against LED flare 101 during charging with charger contacts 503 aligned and in electrical connection with charging posts 123. Power cord 511 may include a USB type connector 513 that is adapted to be plugged directly into a USB port on a computer (not shown), other device with a standard USB port to provide power to charger 501, or AC adapter 515 as shown in FIG. 5C.

Figure 5E:
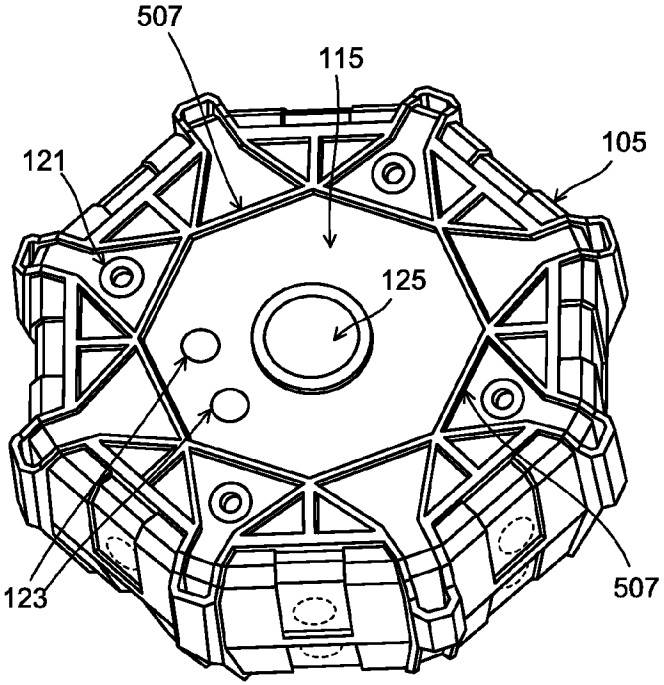
Figure 5D:
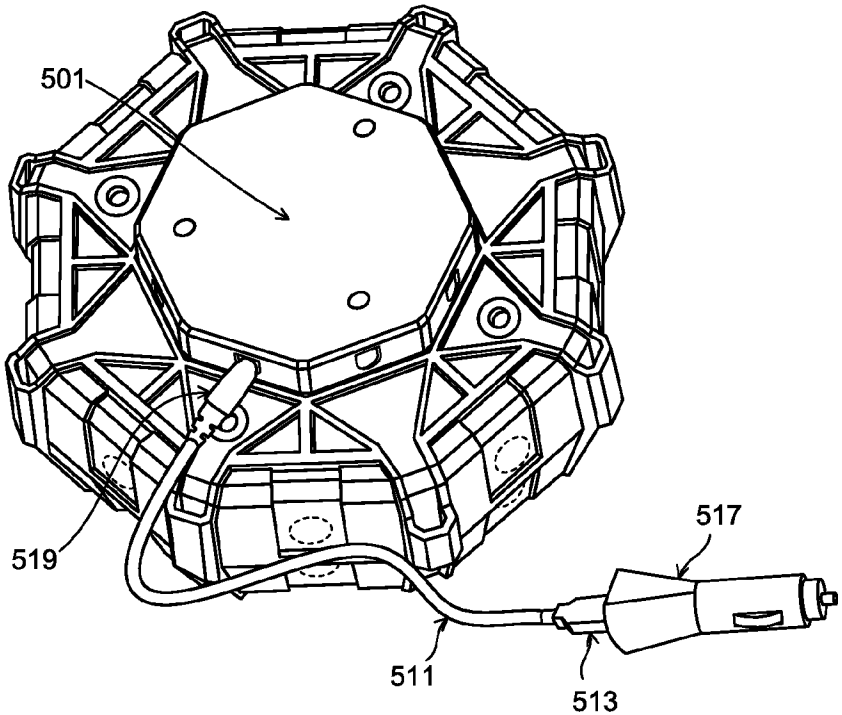

Alternatively, as shown in FIG. 5D, USB connector 513 may be connected to a DC adapter such as a standard vehicle lighter adapter 517 for drawing power from a car lighter. FIG. 5E shows a LED flare 101 with attachment device 125 and charging posts 123 that are configured to connect to charger 501 as shown in FIGS. 5A-5D.

Figure 6B:
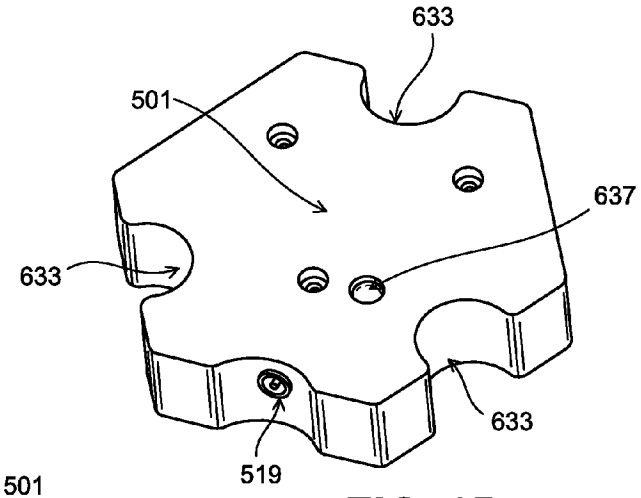
FIGS. 6A-6C show perspective views of a LED flare charger by itself and in charging position on a LED flare in a second embodiment.
Figure 6C:
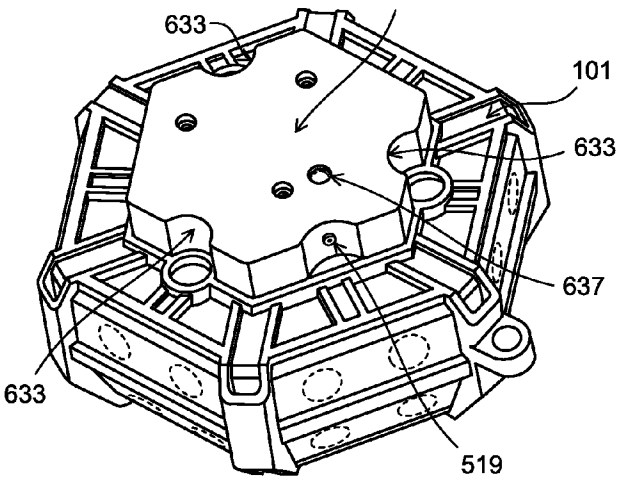
Figure 6A:
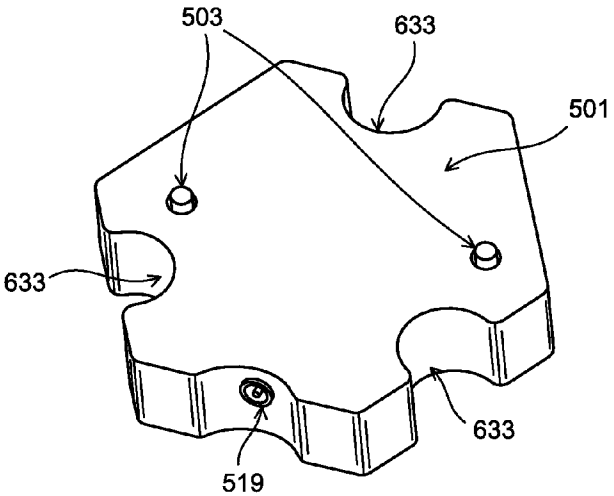

FIGS. 6A-C shows an alternative embodiment for a charger designed for use with a hexagonally shaped flare 101. The overall shape of charger 501 in this second embodiment is hexagonal with cutouts 633 and a connector 519 for the power cord (not shown). A power indicator light 637 indicates when charging is active. Charger 501 in this six sided embodiment operates in the same manner as eight sided charger 501

(described above) with charger contacts 503 protruding to make contact with charging posts 123 when charger 501 is in place against flare 101.

Figure 7:
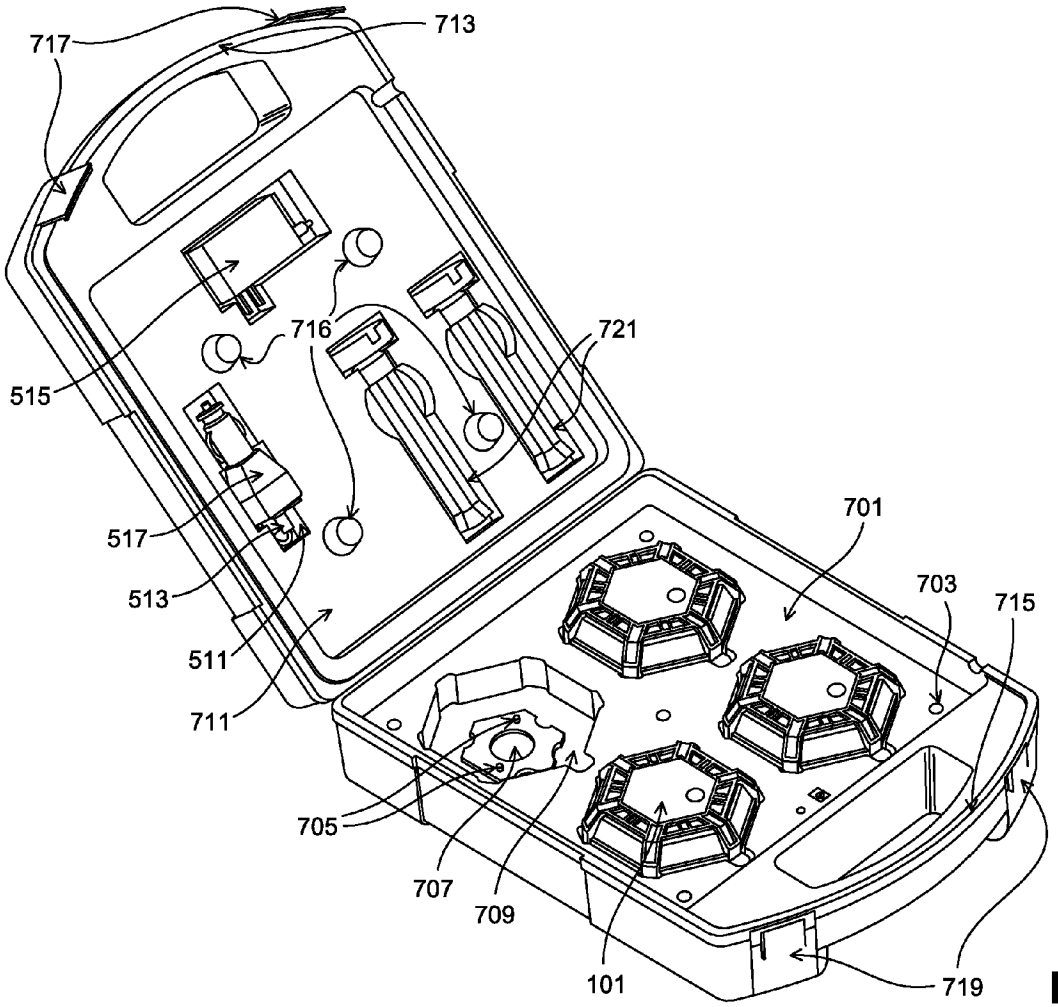
FIG. 7 is a perspective view of a carrying case kit with LED flares and accessories.

FIG. 7 is a perspective view of a carrying case base 701 capable of holding four LED flares 101 with integrated charging for each LED flare 101, and storage areas for accessories including power cord 511 with USB connector 513, AC adapter 515 and DC adapter 517. Carrying case base 701 is equipped with integrated charger contacts 705 to re-charge the batteries of LED flares 101 when placed in carrying case 701. Power cord 511 can be plugged into carrying case base 701 at carrying case base connector 703. The other end of power cord 515 is then plugged into a power source such as a USB port on a computer, an AC outlet using AC adapter 515 or DC adapter 517. A pair of case charger contacts 705 are integrated into carrying case base 701 and function in the same manner as charger contacts 503 on stand-alone charger 501, drawing power through power cord 511 that is connected into carrying case base 701 at case connector 703. An attachment device such as a magnet 707 holds flare 101 in place in a recessed slot 709 of carrying case base 701. Magnet 707 is particularly useful if charging is being performed with the case open and where there may be a chance of LED flare 101 being knocked out carrying case base 701, or to prevent rattling of LED flare 101 in carrying case base 701.

In the embodiment shown in FIG. 7, carrying case base 701 has a hinged cover 711 with a cover handle 713 that lines up with base handle 715 when cover 711 is closed. Protrusions 716 in cover 711 are appropriately shaped, and aligned with recessed slots 709 in carrying case base 701 to hold LED flares 101 and accessories such as flare stands 721 firmly in place when carrying case base 701 is in the closed position. Cover 711 may be locked in place on carrying case 701 by snapping down clasps 717 over protrusions 719 on carrying case base 701.

Carrying case base 701 and cover 711 may be manufactured using molded plastic which is lightweight, hollow and durable. Wires (not shown) may be run inside of the hollow area in base 701 between connector 703 and charger contacts 705.

Figure 8:
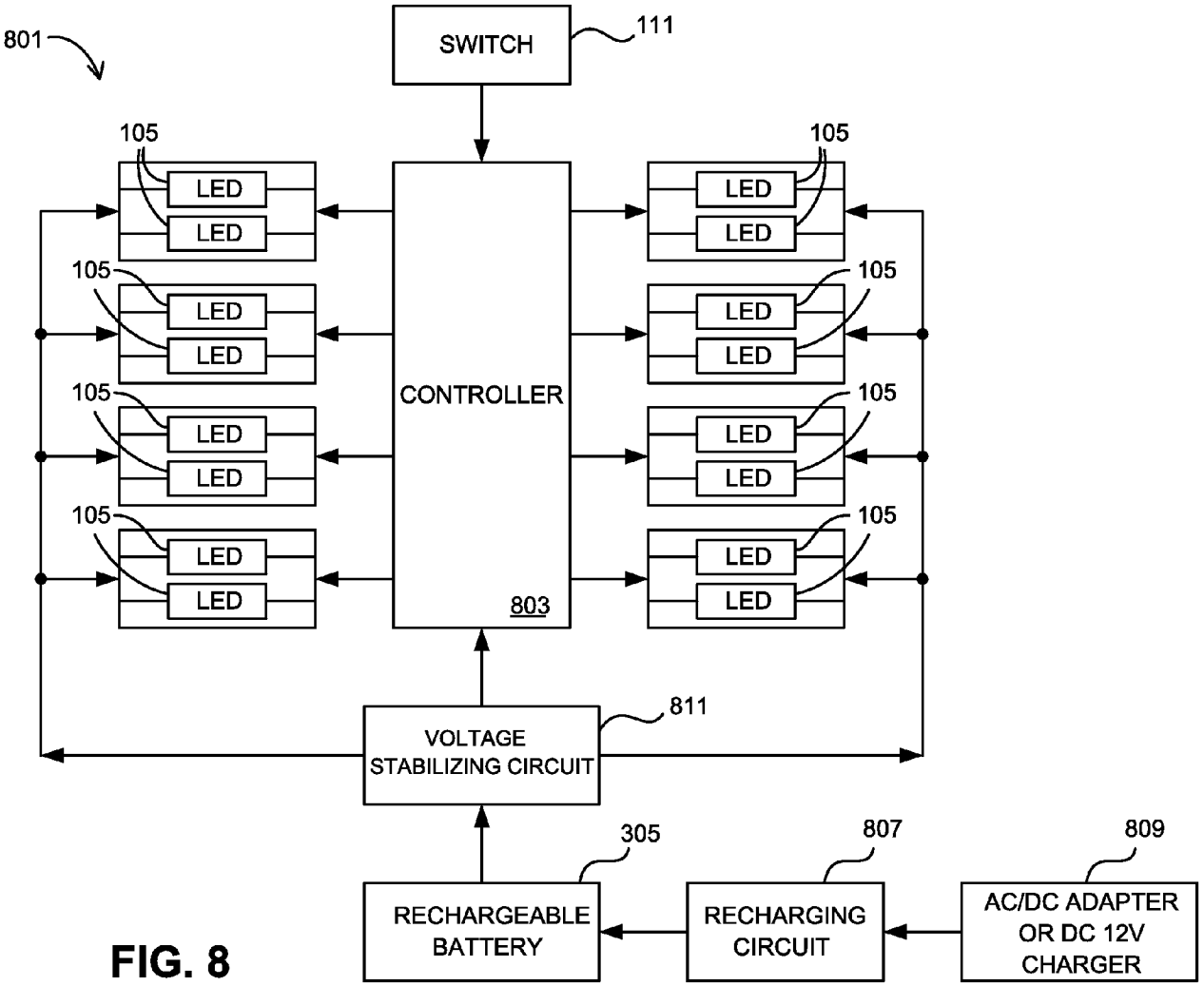
FIG. 8 shows a block diagram of an electrical circuit of the LED flare.

FIG. 8 is a block diagram of a circuit 801 mounted on one of the LED panels 303*a* or 303*b*, and enclosed within the housing of flare 101 made up of lower panel 105 and upper panel 107. Circuit 801 includes a controller 803 for controlling the operation of the multiple LEDs 105 housed within flare 101. Controller 803 is typically an integrated circuit and is programmed with one or more patterns for flashing and/or maintaining illumination of LEDs 105. Switch 111 is used to power on and power off flare 101. Switch 111 may also be used to cycle through any number of different light patterns of flare 101. For example, each LED 105 may be turned on for a fraction of a second in the sequential order as they are positioned around the periphery of flare 101. Alternatively, illumination may be set to alternate between LEDs 105 on opposing sides of the housing of flare 101. It should be understood that the number of patterns possible is only limited by the number of LEDs 105 that are used in flare 101.

Controller 803 is powered by a battery 305, which in turn is recharged by a recharging circuit 807 connected to an adapter 809. Adapter 809 may be either an AC adapter 515 or a DC adapter 517 for supplying AC or DC to circuit 801 from a wall outlet, a cigarette lighter or another power source. A voltage stabilizing circuit 811 receives power supplied by battery 305 and delivers it directly to controller 803 and LEDs 105.

Figure 9:
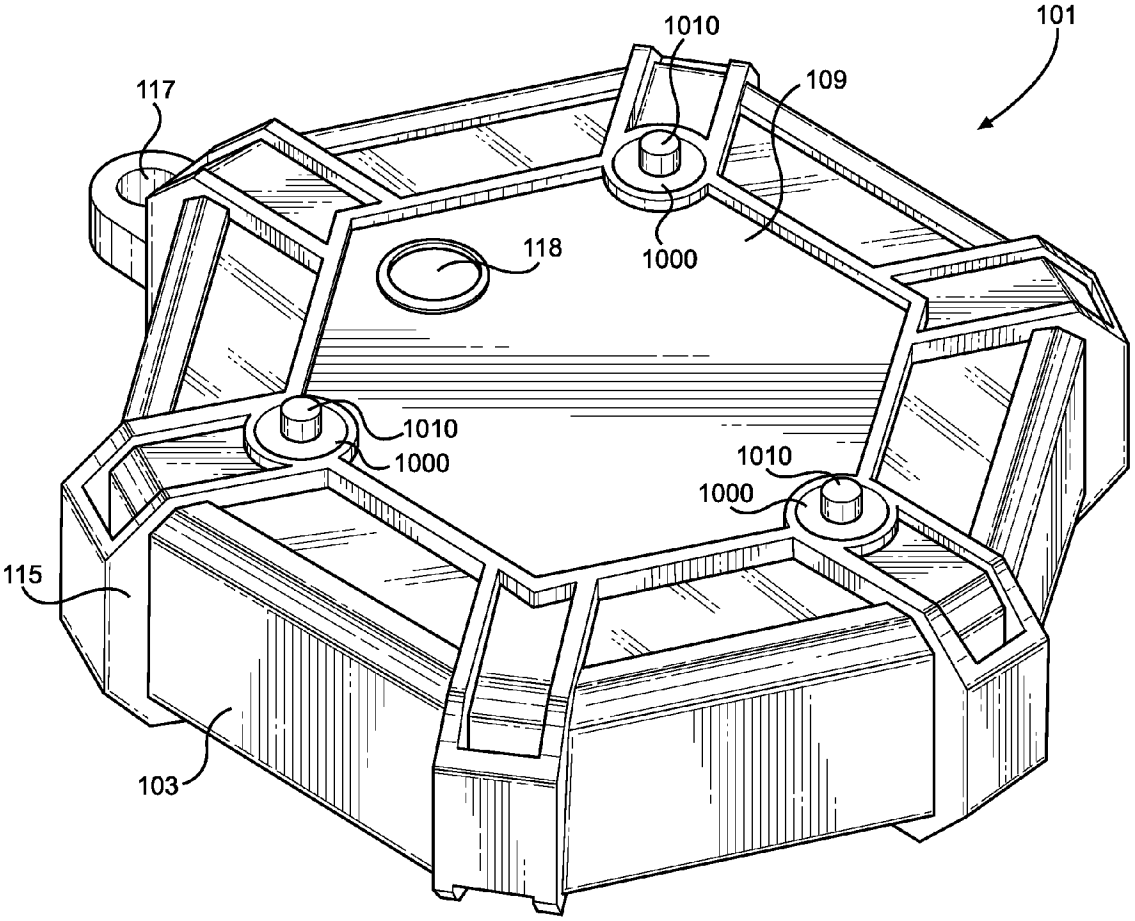
FIG. 9 shows a perspective view of an LED flare in a third embodiment.
Figure 10B:
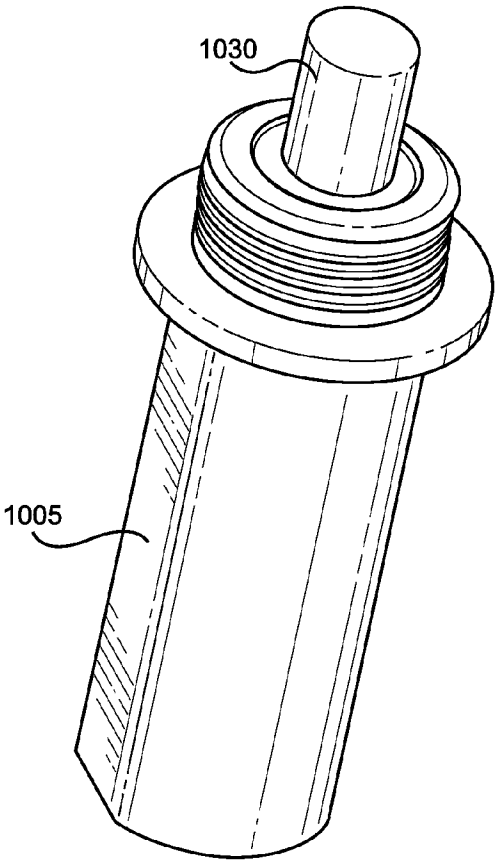
FIGS. 10A-E show the components of a retractable charger contact pin for use in a stackable charging LED flare.
Figure 10A:
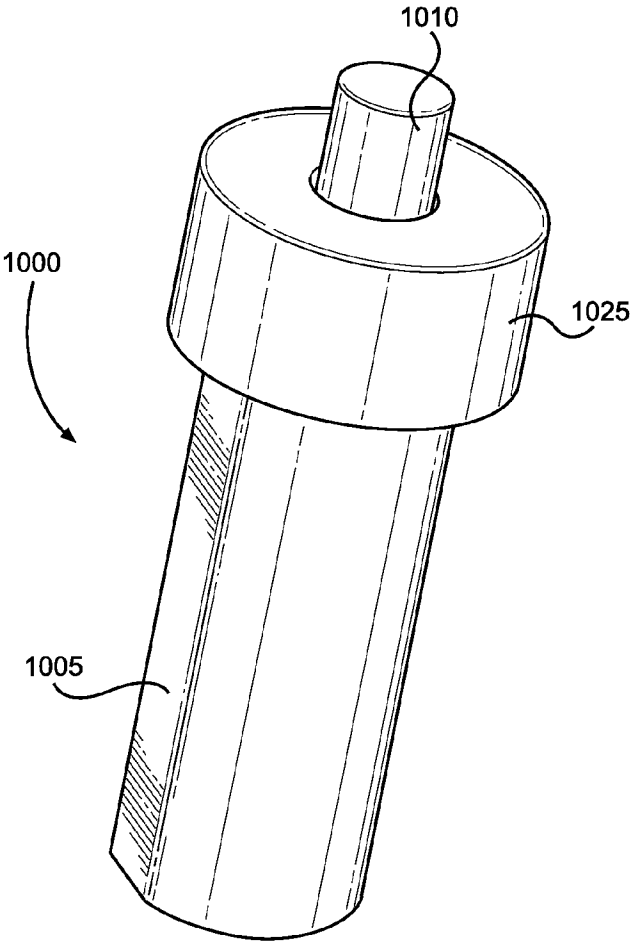
Figure 10D:
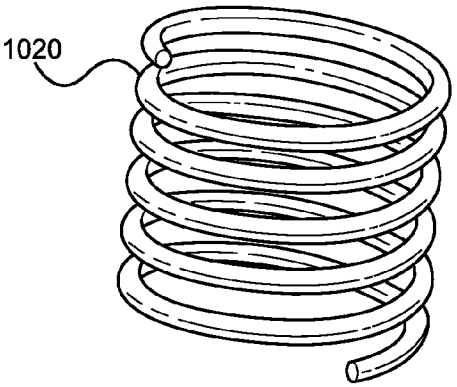
Figure 10E:
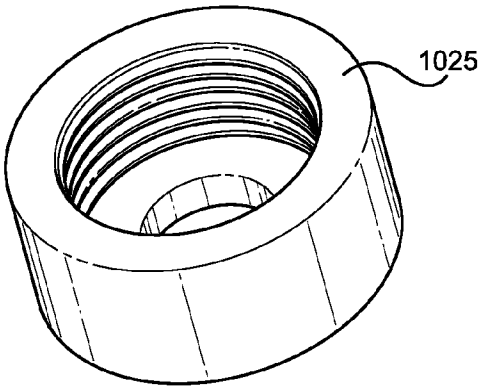
Figure 10C:
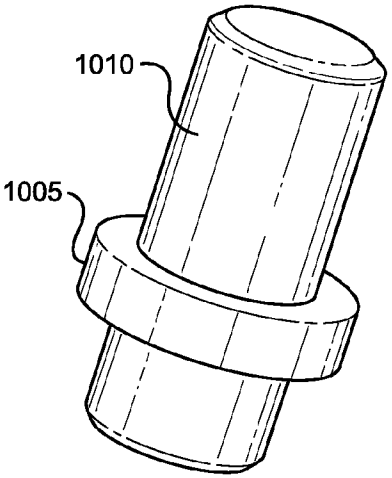

FIG. 9 is a top perspective view of a third embodiment of LED flare 101. In this third embodiment, LED flare 101 is designed with six flat sides without a tapered upper side panel as in LED flare 101 of the first and second embodiments in FIGS. 1A-1F and 2A-F, respectively. LED flare 101 of the third embodiment with six sides may have dimensions as follows: top and bottom diameter—approximately 3.975 inches (100.965 mm); side panel width—approximately 0.730 inches (18.542 mm) and side panel height—approximately 1.25 inches (3.175 cm). These dimensions are provided solely as an example, and other dimensions can be implemented as desired. It should be understood that throughout the specification, reference to LED flare 101 shall include but not be limited to a flare with 6 or 8 sides where each side is flat with a single panel on each side as shown in FIG. 9, or with two or more subpanels on each side (for example as shown in FIGS. 1A-1F and 2A-2F) where an upper or lower side subpanel may be angled and tapered to join the top or bottom of the flare, or in any number of other practical configurations.

LED flare 101 is configured to be stacked. Stacking two or more LED flares 101 makes simultaneous charging possible with a single charger eliminating the need for a separate charger for each LED flare and saving space compared to a charging kit where multiple flares may be charged simultaneously in individual charging positions, for example as shown in the portable charging case of FIG. 7.

FIGS. 10A-E show the components of a spring-loaded contact pin 1000 for use in stackable LEDs with a multi-flare charging feature. Spring-loaded contact pin 1000 has: 1) a base 1005 that is shown in detail in FIG. 10B; 2) a floating contact 1010 with a cylindrical collar 1015 shown in detail in FIG. 10C; 3) a spring 1020 shown in detail in FIG. 10D that biases the floating contact 1010; and 4) a screwable crown 1025 shown in detail in FIG. 10E. When assembled, spring-loaded contact pin 1000 has spring 1020 fitted over the top of floating contact 1010. The top portion of floating contact 1010 fits through the hole in crown 1025 with spring 1020 biasing floating contact 1010 in a downward direction when crown 1025 is screwed down over the top of base 1005. Base portion 1005 fits inside of a hole that replaces binding posts 119 (as shown in FIG. 3A) in top 109 of flare 101.

Figure 11A:
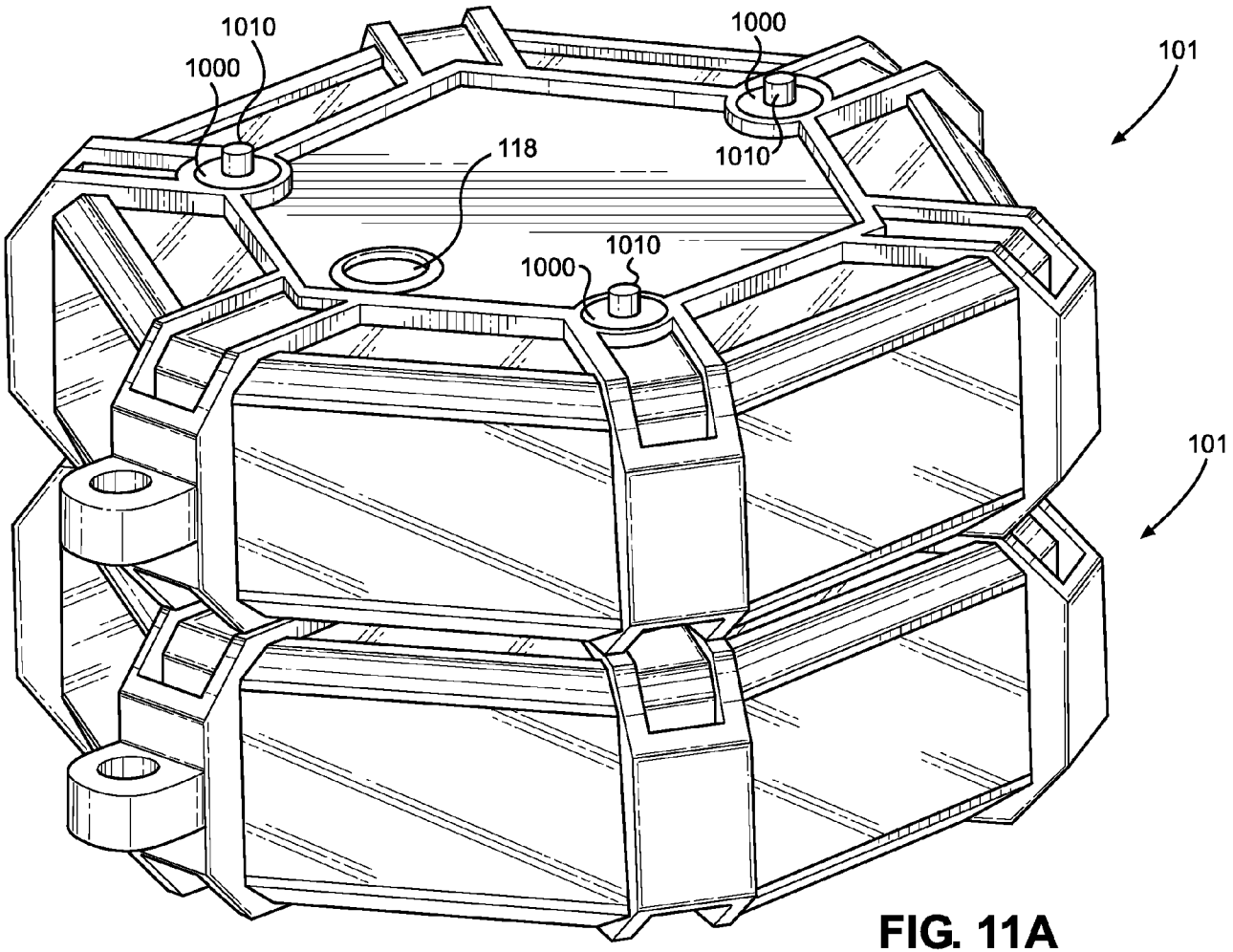
FIGS. 11A-C show views of two stacked LED flares.
Figure 11B:
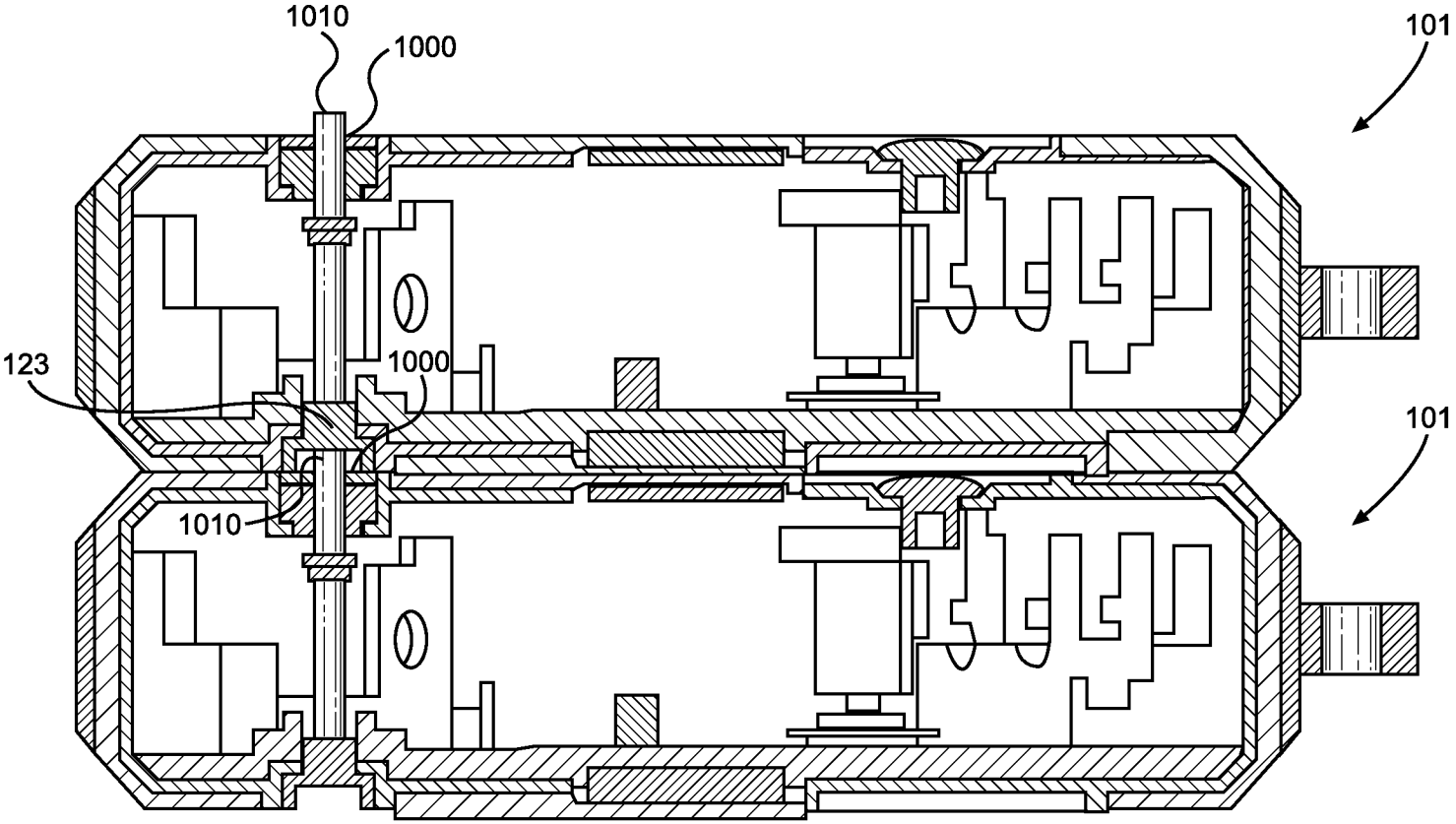
Figure 11C:
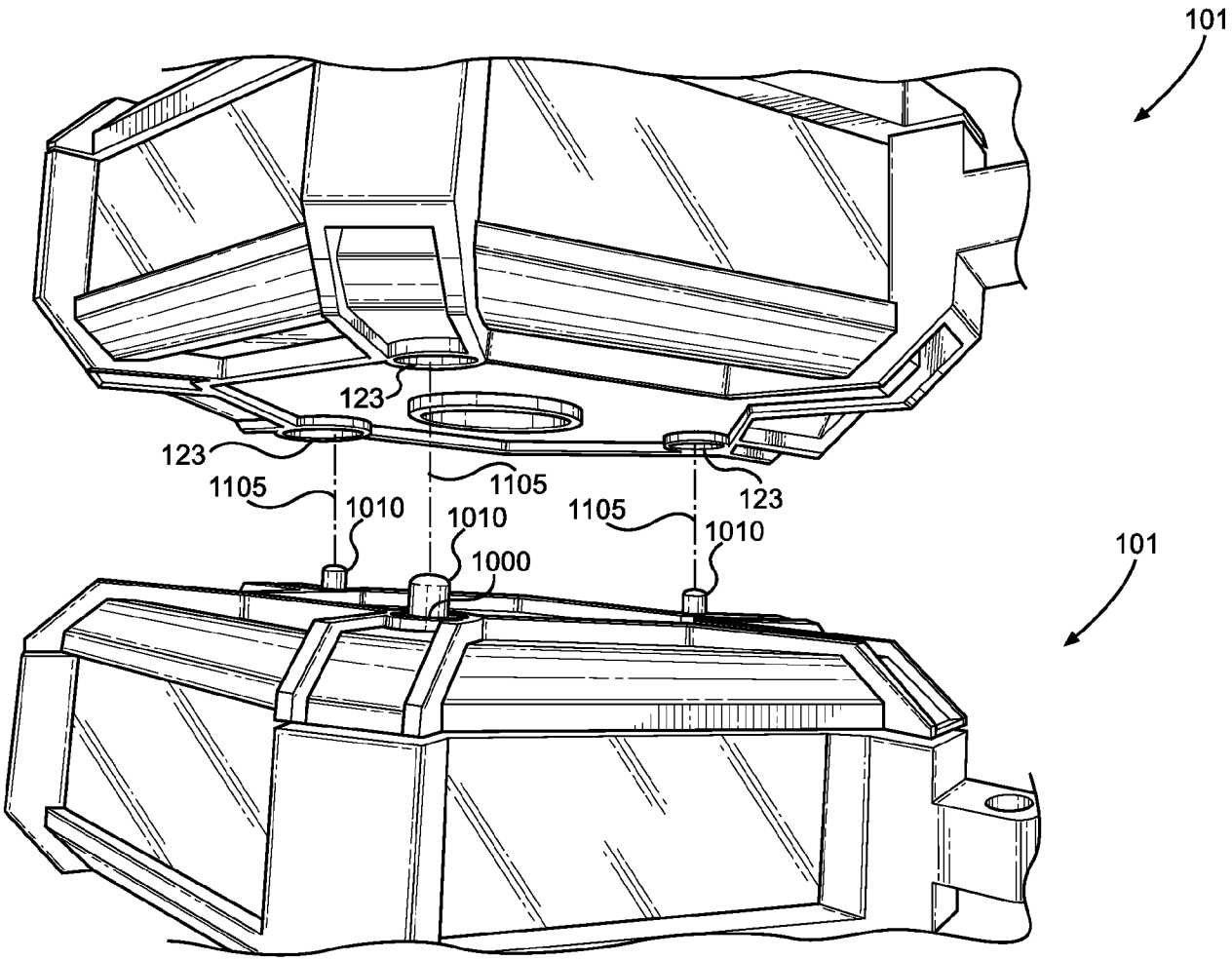

FIGS. 11A-C show views of two stacked LED flares. Spring-loaded contact pins 1000 with floating contacts 1010 can be seen in top 109 of flare 101 in FIG. 11A. FIG. 11B is a cut-away side view of two LED flares 101 stacked in alignment. FIG. 11C is a perspective view of two flares that are aligned and in a ready position to be stacked. As can be seen, the lower flare 101 has contact pin 1000 aligned to contact charging post 123 of the LED flare that is positioned above it. In this way, charging may occur simultaneously for any number of stacked flares as the charge flows through the lower flare and passes through to the flare above it. Floating contact 1010 of lower flare 101 is depressed in a downward direction when it comes in contact with charging post 123 of upper flare 101 above it ensuring that good contact is made as long as the two flares are in the stacked position. Dotted lines 1105 show the alignment between contact charging posts 123 in upper flare 101 and floating contacts 101 on lower flare 101.

Figure 12A:
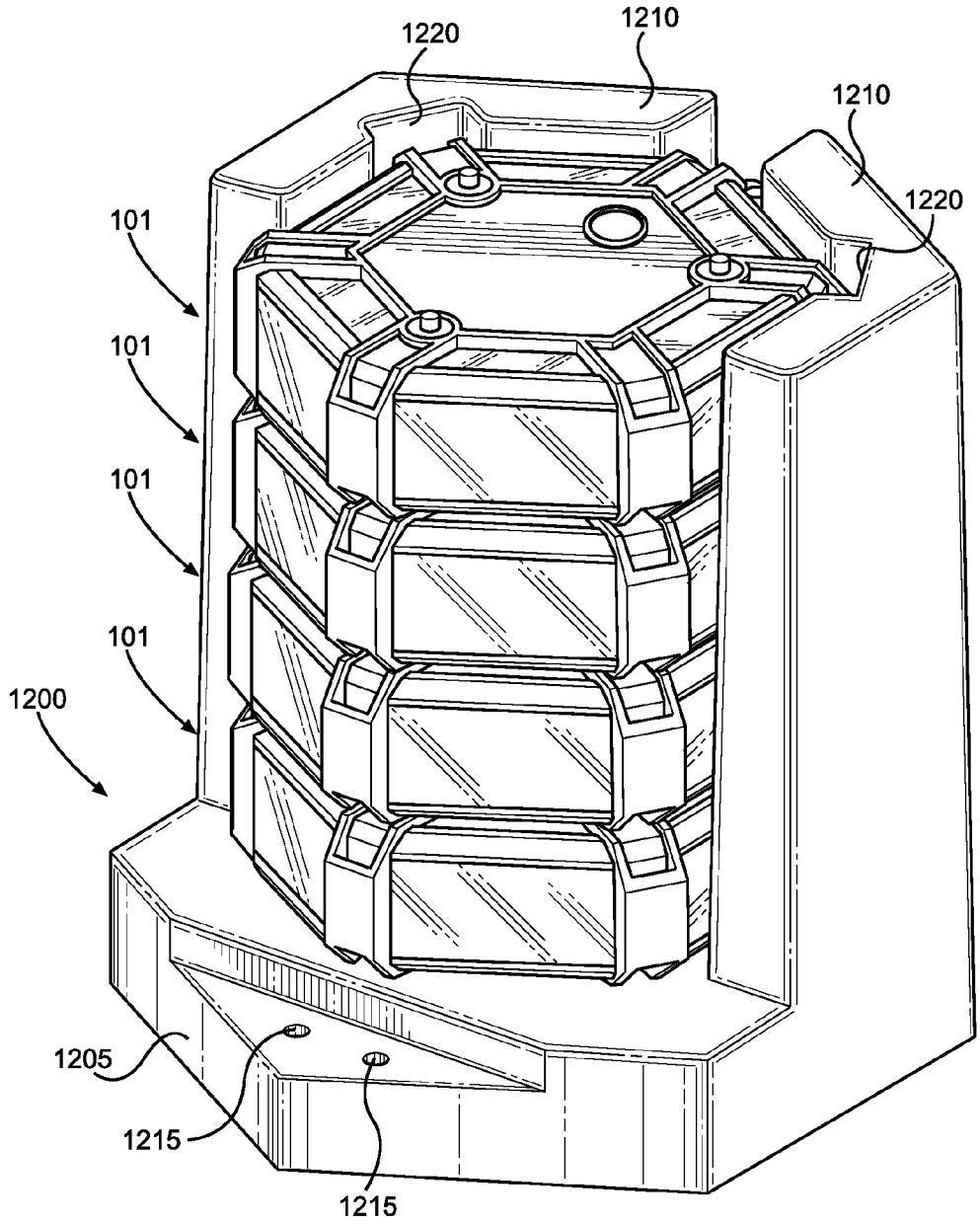
FIGS. 12A-D show views of multiple stacked LEDs and embodiments of charger stations for charging multiple LEDs at the same time.
Figure 12B:
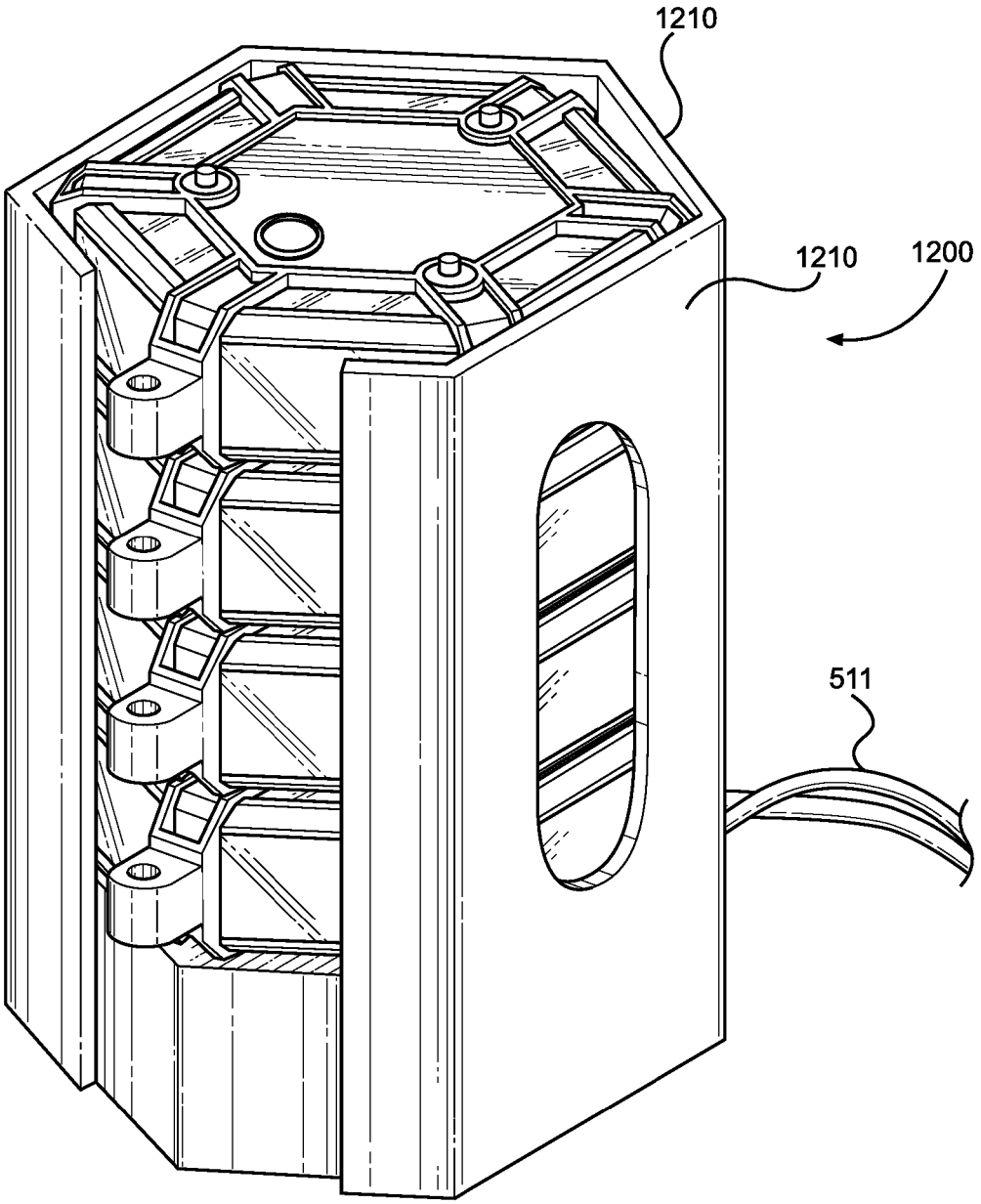

FIGS. 12A and 12B show four stacked LED flares 101 in a first and second embodiment respectively of a charger station 1200. Each charger station 1200 has a base 1205 configured to accept the bottom LED flare. Sidewalls 1210 form a hexagonal interior space to hold each LED flare securely in place in a stack with fitted cut-outs 1220 (FIG. 12A only) to accept shaped portions of the sides of each LED flare. The stack of flares 101 are charged simultaneously as described above with respect to FIGS. 11A-B. Indicator lights 1215 show that the unit is on and operational and whether a complete charge has been achieved.

Figure 12C:
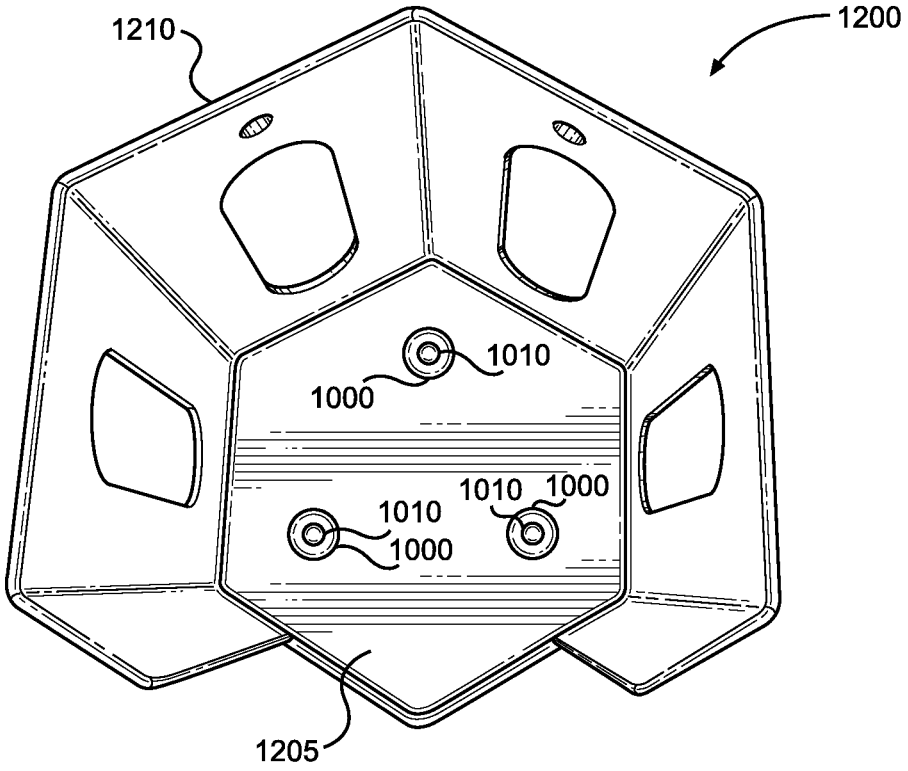

FIG. 12C shows a top down view of the second embodiment of a charger station 1200 without any LED flares loaded for charging. Floating contact pins 1000 similar to those shown on the top of flare 101 in FIG. 11A are positioned in base 1205 to align with charger posts 123 on the bottom of LED flare 101 when it is loaded into base 1205. A cord 511 that plugs into charger station 1200 at one end is plugged into a standard wall outlet and may or may not use an adapter 515 and USB connector 513.

Figure 12D:
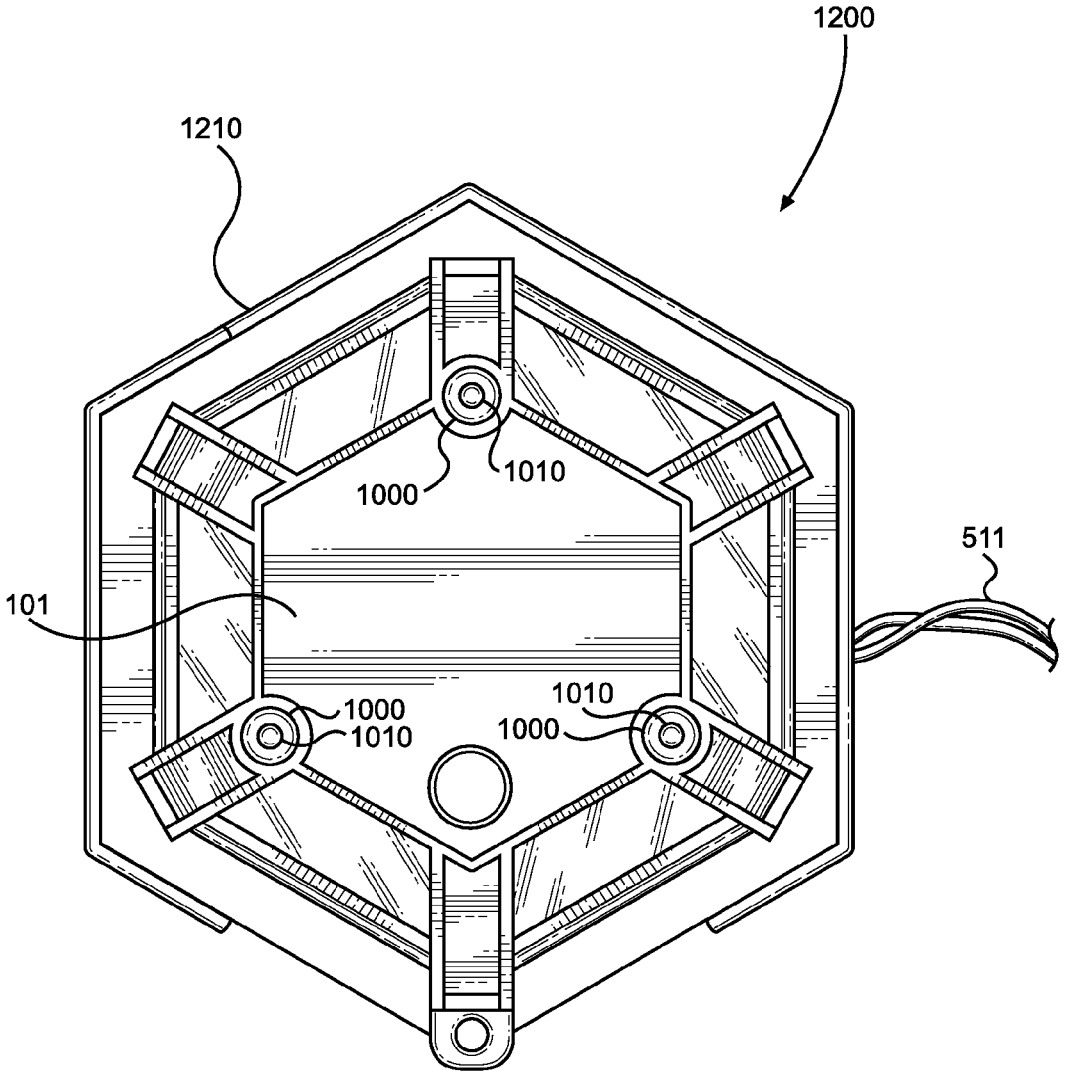

FIG. 12D shows a top down view of the second embodiment of charger station 1200 with flares 101 loaded for charging.

Operation of the invention will now be described with reference to FIGS. 1-12. Initially, flare 101 is powered off. Power is turned on by a user activating switch 111. Power is then delivered from battery 305 through voltage stabilizing circuit 811 to controller 803 and LEDs 105. Controller is programmed with a number of different lighting patterns through which the LEDs are cycled turning them on and off in accordance with the programmed patterns. Each pattern may be used to indicate a signal such as an emergency of a particular type, or just to maintain all of the lights in an illuminated state so that a parked vehicle is visible at night or in low light conditions. To cycle through the different illumination patterns, the user simply depresses switch 111. Alternatively two switches could be implemented with one delivering power and the second for changing the light pattern.

The foregoing invention has been described in accordance with the relevant legal standards, thus the description is exemplary rather than limiting in nature. Variations and modifications to the disclosed embodiment may become apparent to those skilled in the art and fall within the scope of the invention. Accordingly the scope of legal protection afforded this invention can only be determined with reference to the claims. For example, it should be understood that while the invention has been described with respect to a variety of multi-sided LED flares that may be stacked for charging concurrently, the inventive concepts may be applied for use with flares of any shape. These may include round flares, triangular flares, rectangular flares, pentagonal flares or any other shaped designs that are best suited for a particular purpose and chosen by the designer. To meet the requirements of the invention, the flares have a point of contact on a top surface and a point of contact on a bottom surface on which contact pins and charging posts and are positioned so that the charge can be passed through from one flare to the next flare when the flares are positioned in a stack.

What is claimed is:

1. An electrically powered first flare comprising:
- a top;
- a base; and
- a plurality of sides angled relative to each other configured around the periphery of the housing wherein each side includes a side panel situated between the top and the base;
- a plurality of LEDs aligned in windows positioned in at least one of the side panels;
- a switch on the housing for operating the first flare;
- a battery encased in the housing for powering the first flare;
- a circuit encased in the housing that is in electrical connection with the switch, the LEDs and the battery wherein in an active state of the switch, power is switched on and delivered from the battery through the switch to the circuit for operational control, and in an inactive state of the switch, power is switched off;
- charging posts electrically connected to the battery and positioned on the outside of the housing; and
- contacts electrically connected to the charging posts and positioned on the outside of the housing wherein when the first flare is engaged with a charger, the contacts deliver a charge to an electrically powered second flare that is aligned for charging with the first flare.

2. The apparatus of claim 1 wherein the circuit further comprises a controller programmed to provide at least one illumination pattern that is performed by the LEDs during operation of the first flare.

3. The apparatus of claim 1 further comprising an attachment device for holding an external charger in place against the contacts during a charging operation.

4. The apparatus of claim 3 wherein the attachment device is a magnet.

5. The apparatus of claim 1 further comprising a protective casing that fits over an outer surface of the housing with a plurality of openings aligned with the positions of the LEDs.

6. The apparatus of claim 5 wherein the contacts are recessed in the protective casing on the housing.

7. The apparatus of claim 5 wherein the protective casing further comprises loops positioned at a junction of each pair of side panels along an outer surface of the sides of the housing wherein any two adjacent loops form opposed feet on which the flare may be stably positioned.

8. The apparatus of claim 1 wherein the housing further comprises a plurality of LED windows that are integrated in the side panels of the housing and aligned with the positions of the LEDs, the windows being generally convex in shape to magnify the intensity of the light emitted from the LEDs.

9. The apparatus of claim 1 further comprising a light focusing component to channel light from at least one of the LEDs in a radially outward direction.

10. The apparatus of claim 1 wherein for at least one position of a LED in the plurality of LEDs, at least two LEDs are positioned.

11. The apparatus of claim 10 wherein the at least two LEDs are either stacked or adjacent to each other.

12. The apparatus of claim 1 wherein the contacts further comprise:
- a base with a protrusion; and
- a floating contact fitting over the protrusion.

13. The system of claim 1 further comprising a carrying case comprising:
- at least one recess for receiving at least one flare;
- a set of integrated charging contacts in each recess for electrically contacting the contacts on the flare when the flare is positioned in a selected recess.

14. The system of claim 1 wherein the carrying case further comprises an accessory recess area for storing a charger adapter and cord.

15. A system for providing a warning in low light conditions comprising:
- at least two LED flares each including:
  - a housing comprising:
    - a top;
    - a base; and
    - a side between the top and the base and configured around the periphery of the housing;
  - a plurality of LEDs aligned in windows positioned in the side;
  - a switch on the housing for operating the flare;
  - a battery encased in the housing for powering the flare;
  - a circuit encased in the housing that is in electrical connection with the switch, the LEDs and the battery wherein in an active state of the switch, power is switched on and delivered from the battery through the switch to the circuit for operational control, and in an inactive state of the switch, power is switched off;

charging posts electrically connected to the battery and positioned on the outside of the housing;

contacts electrically connected to the charging posts and positioned on the outside of the housing wherein when a first flare is engaged with a charger, the contacts deliver a charge to an electrically powered second flare that is aligned for charging with the first flare; and the charger including:

a base for holding the at least two LED flares wherein the base comprises integrated charging contacts for electrically contacting the contacts on the first flare;

wherein at least one second flare is electrically aligned with the first LED flare with the charging posts of the second flare contacting the contacts of the first flare such that the first flare and the second flare are charged simultaneously.

16. The apparatus of claim 15 wherein the circuit further comprises a controller programmed to provide at least one illumination pattern that is performed by the LEDs during operation of the flare.

17. The apparatus of claim 15 wherein the flare further comprises a flare attachment device in the housing.

18. The apparatus of claim 15 further comprising a protective casing that fits over an outer surface of the housing with a plurality of openings aligned with the positions of the LEDs.

19. The apparatus of claim 15 wherein the contacts are recessed in a protective casing on the housing.

20. The apparatus of claim 19 wherein the protective casing further comprises loops positioned along the outer surface of the sides of the housing wherein any two adjacent loops form opposed feet on which the flare may be stably positioned.

21. The apparatus of claim 15 wherein the housing further comprises a plurality of LED windows that are integrated in the housing and aligned with the position of the LEDs, the windows being generally convex in shape to magnify the intensity of the light emitted from the LEDs.

22. The apparatus of claim 15 wherein for at least one position of a LED in the plurality of LEDs at least two LEDs are positioned.

23. The apparatus of claim 22 wherein the at least two LEDs are either stacked or adjacent to each other.

24. The apparatus of claim 15 wherein the housing further comprises a plurality of LED windows that are integrated in the housing and aligned with the positions of the LEDs, the windows being generally convex in shape to magnify the intensity of the light emitted from the LEDs.

25. The apparatus of claim 15 further comprising a light focusing component to channel light from at least one of the LEDs in a radially outward direction.

26. The apparatus of claim 15 wherein the contacts further comprise:

a base with a protrusion; and a floating contact fitting over the protrusion.

27. The apparatus of claim 15 wherein the charger further comprises at least one side wall extending from the base and configured to secure the at least two flares in place during a charging operation.

28. A method of charging a power source in at least two LED flares simultaneously, comprising:

providing a charging station, the charging station comprising:

a base portion with an upper surface;

a set of charging station contacts on the base portion; and at least two side members extending from an edge of the upper surface of the base portion with a gap formed between two of the side members;

positioning a first flare on the base in the charging station wherein a set of first flare contacts on a first side of the first flare are aligned with and in electrical connection with the set of charging station contacts and in electrical connection with a first flare power source, and further wherein the first flare is maintained in the charging station by the side members with a protrusion on the first flare positioned in the gap;

aligning at least a second flare with the first flare wherein a set of second flare contacts on a first side of the second flare are in electrical connection with a set of first flare pass-through contacts on a second side of the first flare and a second flare power source, and further wherein the second flare is maintained in the charging station by the side members with a protrusion on the second flare positioned in the gap; and providing a charge to the charging station contacts, wherein the charge is passed through the charging station contacts to the first flare contacts, and through to the first flare pass-through contacts and to the second flare contacts, and further wherein charging of the first flare power source and the second flare power source are charged simultaneously.

29. The method of claim 28 wherein the second flare is stacked in vertical alignment on the first flare.

30. The method of claim 28 wherein at least a subgroup of the contacts are spring loaded such that the spring-loaded contacts are depressed when at least two flares are stacked in vertical alignment.

* * * * *